United States Patent [19]

Ceintrey et al.

[11] 4,370,397

[45] Jan. 25, 1983

[54] PRESENSITIZED PLASTIC CARD, TAMPERPROOF IDENTIFICATION CARD PREPARED THEREFROM, AND PROCESS FOR MANUFACTURE OF TAMPERPROOF IDENTIFICATION CARD

[75] Inventors: Claude Ceintrey, Neuville les Dieppe; Monique Détain, Aubermesnil Beaumais, both of France

[73] Assignee: Rhone-Poulenc Systemes, Creteil, France

[21] Appl. No.: 142,764

[22] Filed: Apr. 22, 1980

[30] Foreign Application Priority Data

Apr. 24, 1979 [FR] France ..... 79 10375

[51] Int. Cl.[3] ..... G03C 3/00; G09F 3/02

[52] U.S. Cl. ..... 430/10; 430/8; 430/162; 430/176

[58] Field of Search ..... 430/10, 8, 176, 162

[56] References Cited

U.S. PATENT DOCUMENTS

| | | | |
|---|---|---|---|
| 3,002,851 | 10/1961 | Sorkin et al. | 430/169 |
| 3,046,128 | 7/1962 | Klimkowski et al. | 430/162 |
| 3,301,679 | 1/1967 | Halperin et al. | 430/162 |
| 3,640,714 | 2/1972 | Champ et al. | 430/8 |
| 3,754,916 | 8/1973 | Winslow et al. | 430/162 |
| 3,871,119 | 3/1975 | Mayer | 430/10 |
| 3,949,501 | 4/1976 | Andrews et al. | 430/10 |

*Primary Examiner*—Charles L. Bowers, Jr.
*Attorney, Agent, or Firm*—Sherman & Shalloway

[57] ABSTRACT

A tamperproof identification card such as a passport or credit card is provided. A diazo photosensitive composition is intimately mixed with a thermo-adhesive resin and is carefully deposited as a uniformly thin layer in one or more zones on a plastic support material. The zones of the photosensitive compositions are developed to reproduce identifying information such as a photograph, identification number, etc. A plastic protective film is then laminated to the support to protect the identifying information. Since the adhesive resin material is intimately mixed throughout the photosensitive composition, the protective plastic film cannot be removed without destroying the information.

20 Claims, 4 Drawing Figures

PRESENSITIZED PLASTIC CARD, TAMPERPROOF IDENTIFICATION CARD PREPARED THEREFROM, AND PROCESS FOR MANUFACTURE OF TAMPERPROOF IDENTIFICATION CARD

BACKGROUND OF THE INVENTION

1. Field of the Invention

The present invention relates to a presensitized plastic card which can be used to prepare an identification (I.D.) card, a tamperproof I.D. card prepared therefrom, and a method of preparing said tamperproof identification card. More particularly, this invention relates to a tamperproof identification card of the type including a photographic image and other indicia for identifying the owner or holder of the card, a presensitized plastic card used to prepare the tamperproof I.D. card, and a process for preparing the tamperproof I.D. card in which a thermo-adhesive resin is incorporated in a photosensitive composition which is exposed and developed to reproduce the identification information.

2. Discussion of the Prior Art

The use of identity cards has become very wide spread in recent years, particularly in situations requiring identity control, such as passports, credit cards, banking cards, security employee cards, etc. In all of these cases it is desired to protect the identity card from tampering by unauthorized persons to protect the integrity of the card.

It is known, for example, to prepare cards of this type in which a thin film covered with a photograph of the owner or holder and certain identifying information, for example the name of the owner or holder, an identification number of other information, is glued to a polyvinyl chloride support. A film of transparent plastic material is glued to the surface in such a way that the whole is protected against damage. However, these identification cards are not entirely inviolable since the protective film can be easily unglued and the photograph can be changed or retouched.

One means for overcoming this disadvantage is to effect the photograph by the deposition of a photosensitive layer directly on the support, (see French Pat. No. 2,129,198). According to this patent, a support of polyvinyl chloride or other plastic material is covered with a photosensitive layer composed of a product sold under the trade name Dylux. According to the teachings in the French patent, the identifying information, e.g., alphanumeric inscriptions, and the photograph are reproduced on the photosensitive layer after the card is covered with its transparent protective film.

While providing some improvement these identification cards still suffer from several disadvantages due principally to the fact that the photosensitive emulsion is not temperature resistant. Since the lamination of the protective film to the support usually is affected by the application of heat, the photosensitive layer is susceptible to deterioration.

Moreover, the stabilization of the photograph, in the case of a simple exposure to light, is not uniform throughout the depth of the photograph. However, since the photosensitive material is protected by a transparent film it is no longer possible to stabilize the image after development by washing.

According to U.S. Pat. No. 3,002,851, an identification card is prepared by coating a support of polyvinyl chloride with a photosensitive diazo solution such as condensed paradiazodiphenylamine formaldehyde, to which a sufficiently high pressure is exerted at an elevated temperature so that the photosensitive layer will pass partially into the support. However, it has been found that the adherence of the layer to the support is still insufficient. Therefore, if a protective film customarily used for identification cards is laminated to the coated support, there is observed only a weak adherence of the protective film and, in addition, the information tends to transfer to the protective film in the course of the delamination of the latter.

In addition, the photosensitive layer tends to be easily attacked by solvents, such as acetone.

It has recently been proposed in U.S. Pat. No. 4,115,618 to provide an identification card which provides a "security seal" between the photograph and the surface of the protective plastic material bonded thereto. This patent provides as the protective film a plastomeric sheet material comprising a cellulose ester sheet, one surface of which is hydrolyzed and bonded to the hydrolyzed surface, a layer consisting essentially of a mixture of hydrolyzed polyvinyl alcohol and a low molecular weight polyvinyl acetate. These identification cards use Polaroid diffusion transfer color images which are of the silver type.

This system also has several difficulties and drawbacks due principally to the use of silver type photographs. These photographs are expensive and requires a delicate process for their use. For example, it is necessary to apply the protective film immediately after the development of the film while the photograph is still wet. Furthermore, the security seal does not render this card tamperproof since it is still possible to completely tear off the protective film and the photograph and to replace them with a new photograph and a new protective film. In addition, these identification cards present significant thicknesses on the order of several tenths of millimeters to accomodate the photographs.

Accordingly, there has not yet been a single identification card which is substantially inviolable and tamperproof and which offers a total adherence between the support and the photograph or other information as well as between the photograph and the protective film, without significant thickness and, at the same time, which is simple to produce and inexpensive.

These disadvantages are now remedied by the tamperproof identification cards of the present invention. Accordingly, a principal object of the present invention is to provide tamperproof identification cards which are simple and inexpensive to produce and use readily available materials.

It is a further object of this invention to provide a tamperproof identification card which includes a photograph of the owner or holder and which provide adherence between the support and the photograph as well as between the photograph and the protective film.

A further object of the present invention is to provide a presensitized plastic card from which the tamperproof identification cards of the subject invention can be produced.

A still further object of the present invention is to provide a process for preparing the tamperproof identification cards.

These and other objects of the present invention will become more apparent from the following description and accompanying drawings in which:

SUMMARY OF THE INVENTION

Figure 1:
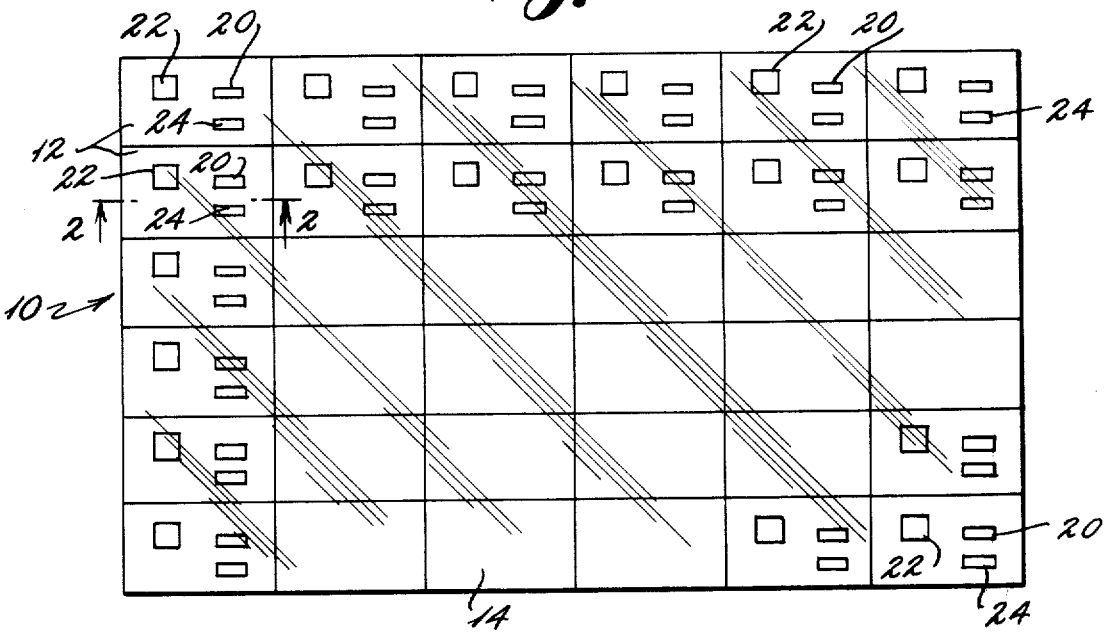
FIG. 1 is a plan view of an array of tamperproof identification cards according to the invention.

In one aspect, the present invention provides a presensitized plastic card which can be used to prepare the identification card containing a photograph, images, indicia, and other forms of information such as names, identification number, etc. The presensitized plastic card is formed by a plastic support and one or more photosensitive zones carried on at least one of the major surfaces of the support. Each of the zones comprises a layer of a diazo photosensitive composition deposited as a thin, uniform layer, preferably by serigraphy. In the present invention, the photosensitive composition used comprises an intimate mixture of at least one photosensitive diazonium salt and a coupling agent therefore, and at least one thermally activated adhesive resin having a VICAT softening point in the range of from about 40° C. to about 140° C. Preferably, the weight ratio of the diazonium salt plus coupling agent to the adhesive resin is in the range of from about 50:50 to about 5:95.

The present invention also provides a tamperproof identification card formed from the above-described presensitized plastic card which has been exposed to actinic light through an original to be reproduced to decompose the diazonium salt in the exposed zones, the material then being developed in an alkaline medium and then dried. A protective plastic film is laminated to the support and the image(s) provided by the dried, developed photosensitive composition. At least one of the support and the protective plastic film is transparent so that the information provided by the developed photosensitive composition can be viewed through either or both of the support and the protective plastic films.

The surface of the protective plastic film facing the support and photosensitive composition will preferably be coated with a second thermally activated adhesive resin having a VICAT softening point in the range of from about 40° C. to 140° C. The coating can be omitted if the protective plastic film is itself formed from a thermo-adhesive resin material.

In a specific embodiment, the card may be provided with one or more magnetic stripes or raised portions, e.g. embossments, or both, to provide still additional information.

In its broadest sense, the process for the production of a tamperproof identification card bearing one or more sets of indicia or images capable of establishing the identity of the owner or holder thereof comprises the steps of exposing the photosensitive composition of the presensitized plastic card, as described above, through an original to be reproduced to decompose the diazonium salt in the exposed zones and developing the unexposed zones of the photosensitive layer in an alkaline medium and drying the developed layer; laminating a protective plastic film having at least the major surface thereof facing the developed photosensitive layer and support bearing a second thermally activatable adhesive resin material, by heating, under pressure, the assembly of the protective plastic film and identification card to a temperature above the higher VICAT softening point of the thermally activatable adhesive resin of the photosensitive composition and the protective plastic film and allowing the laminated assembly to cool to room temperature. At least one of the support and the protective plastic film is formed of a transparent plastic material. The process provides a tamperproof identification card whereby any attempt to separate the protective film from the support will result in irreparable damage to the image or indicia of the photosensitive layer. That is, the photosensitive layer is firmly adhered to the support and also to the protective plastic film.

In accordance with a more specific aspect of the process of this invention, the presensitized plastic card is prepared by depositing over one or more zones on a surface of the plastic support layer of a photosensitive solution having a viscosity in the range of from about 600 centipoises to about 4000 centipoises, measured at 20° C., the solution comprising at least one photosensitive diazonium salt, a coupling agent for the salt, at least one thermally activated heated resin having a VICAT softening point in the range of from about 40° to about 140° C., and a solvent having a relative evaporation rate, relative to ethyl ether, of at least 25; and drying the photosensitive solution deposited on the plastic support. The photosensitive solution is deposited on the support in such manner to provide a coating of specific configuration and which is uniformly thin, generally having a thickness in the range from about 1 micron to about 10 microns, after drying.

DETAILED DESCRIPTION OF THE INVENTION AND PREFERRED EMBODIMENTS

One of the advantageous features of the present invention is that the presensitized plastic card remains stable for long periods of time. In addition, the identification card, after photoexposure and development also remains stable for long periods of time. Accordingly, it is not necessary to carry out the process of preparing the tamperproof identification cards continuously or even at the same location. Thus, it is possible, for example, to stockpile a large number of the presensitized plastic cards for subsequent use. It is also possible, for example, to photoexpose and develop less than all of the zones of the photosensitive layer which have been deposited on the plastic support, for example, with sequential identification numbers, and thereafter expose the remaining zones to a photograph of the owner or holder and/or with other identifying information.

With this in mind, the method of producing the tamperproof identification cards according to the present invention include the following steps:

(a) on a support of transparent or opaque plastic material there is locally deposited, by serigraphy, a diazo photosensitive solution with a viscosity between 600 cps and 4000 cps at 20° C., containing at least one photosensitive diazonium salt, a coupling agent for the diazonium salt, and a first thermo-adhesive resin having a VICAT softening point between 40° C. and 140° C., preferably between 50° C. and 100° C., and a solvent having a rate of evaporation higher than 25, preferably higher than 30;

(b) drying the deposited photosensitive layer;

(c) exposing the photosensitive layer at room temperature to ultraviolet radiation through a positive original to be reproduced, in order to decompose the diazonium salt in the exposed zones;

(d) developing the nonexposed zones of the photosensitive layer with the aid of an alkaline medium, and drying the developed image;

(e) placing a protective plastic film of transparent or opaque plastic material formed from or having at least one surface layer of a second thermo-adhesive resin with a VICAT softening point of between 40° C. and 140° C., preferably between 50° C. and 100° C., with the thermo-adhesive material of the film facing and being in contact with the support and/or the images, at least one of the film and the support being of transparent plastic material;

(f) laminating the assembly of the protective plastic film and the plastic support by heating the assembly to a temperature above the higher of the VICAT softening points of the thermo-adhesive resin materials, and under pressure, and (g) cooling the laminated assembly to room temperature.

The resulting identification card is tamperproof in the sense that the protective plastic film and the plastic support can no longer be separated without damaging the images therebetween.

In an alternative embodiment of the process it is possible to deposit the layer of the zones of photosensitive material directly on the protective plastic film and to photoexpose and develop the photosensitive material on the protective plastic film and then assemble and laminate the protective plastic film with the images to the plastic support.

In the preferred practice of the method of production according to the invention, the solvent of the photosensitive solution is also a solvent of the material of the plastic support or, at least, is capable of softening the surface of the plastic support, i.e. the solvent has at least a slight solvating action on the material of the plastic support. The use of such a solvent further promotes the adherence of the photosensitive composition, both before and after development to the support.

It is also important for assuring that the information provided by the developed photosensitive layers cannot be detached from either the protective plastic film or from the plastic support that the photosensitive composition deposited on the support or on the plastic film be in the form of an intimate mixture of the photosensitive diazo salt and coupling agent (plus adjuvants) and the first thermally activated adhesive resin or resins. It has been found that the intimate mixture must be formed prior to depositing the photosensitive layer on the support (or the protective film) in order to arrive at the desired result. Thus, by merely successively depositing a photosensitive layer and then a thermo-adhesive layer, whether in the form of a separate layer deposited over the photosensitive layer or in the form of a coating layer of a second thermo-adhesive resin layer on the protective film, it is not possible to obtain a tamperproof identification card since the protective film can then be easily detached from the card in the zones corresponding to the photosensitive layer.

It has also been found that in order to obtain a total inviolability of the identification card, the first and second thermo-adhesive resins, i.e. the resin in the photosensitive layer and the resin of the protective film, respectively, should each have a VICAT softening point in the range of about 40° C. to about 140° C., preferably between 50° C. and 100° C. By way of example of suitable resin materials having VICAT softening points within this range, mention can be made of polyvinyl acetate, polyvinyl acetochloride, polyvinyl chloride and the polyesters, for example, polyethylene terephthalate, polybutylene terephthalate, etc.

The selection of the particular thermally activatable adhesive resin from among these is not particularly critical; however, the resin of the photosensitive solution should, of course, be compatible with the photosensitive diazonium salt, coupling agent, and any adjuvants present in the photosensitive composition.

By "compatibility" is understood the non-precipitation of the resin or of any of the other components of the photosensitive composition from the photosensitive solution. The presence or absence of precipitation from the photosensitive solution can be determined by routine experimentation by one of ordinary skill in this art. Also, it is obvious that the resin material should not interfere with the sensitivity of the diazonium salt or interfere with the coupling reaction between the diazonium salt and the coupling agent.

The components of the photosensitive composition in addition to the thermo-adhesive resin, include as the color-forming reactants, the diazonium salt and the coupling agent for the diazonium salt and will generally also include one or more adjuvants such as, for example, extenders, stabilizers, organic acids, dyes or pigments, etc. Suitable diazo photosensitive compositions are well known in the art and are commercially available. Any of the photosensitive compositions which are soluble in the organic solvents and which can be prepared with a viscosity between 600 cps and 4000 cps, at 20° C., including the first thermo-adhesive resin, can be used in the present invention.

Generally, any photosensitive diazonium salt which is soluble in organic solvents and which is capable of undergoing a color-forming coupling reaction can be used in the photosensitive compositions of this invention. As examples of suitable diazonium salts, mention can be made of the following: paraphenylene-diamine-N,N-substituted compounds such as paradialkylamino benzene diazonium compounds which may optionally be substituted on the aromatic nucleus with, for example, alkyl, alkoxy, halogen, etc.; heterocyclic amine derivatives of diazonium compounds such as paramorpholine benzene diazonium salts which may also optionally be substituted on the benzene ring by alkyl, alkoxy, halogen, etc.; N,N-substituted ortho-phenylene diamine derivatives and ortho amino-phenyl derivatives such as para-alkyl mercapto benzene diazonium compounds, preferably substituted by alkoxy groups on the benzene ring.

The diazonium compounds may be used in the form of a relatively stable salt with an acid such as sulfuric acid or hydrochloric acid or they may be used in the form of the double salt with, for example, zinc chloride, tin chloride, aluminum sulfate, borofluoride, and the like. Specific examples of diazonium compounds include, for example, 4-diazo-2,5-diethoxyphenyl-morpholine borofluoride; 4-diazo-2-methyl-1-pyrrolidino-benzene-borofluoride; 4-diazo-N,N-diethyl aniline; 4-diazo-N-methyl-N-benzyl aniline; 4-diazo-2-chloro-N,N-diethyl aniline; 4-diazo-2-trifluoro methyl-N,N-diethyl aniline; 4-diazo-N,N-bis-$\beta$-hydroxethyl aniline; 4-diazo-2,5-dibutoxy-N,N-diethyl aniline; 4-diazo-2,5-dimethoxy phenyl ethyl sulfide, 4-diazo-2,5-dibutoxy- N-phenyl morpholine, 4-diazo-N-piperidine, 4-diazo-2,5dibutoxy-N-phenyl piperidine; 2-diazo-4-methylmercapto-N,N'-dimethyl aniline, 2-diazo-5-benzoyl amino-N,N'-dimethyl aniline, etc.

Any of the coupling agents that can be coupled with a photosensitive diazonium compound may be used as the coupling agent in this invention. As examples of suitable couplers, mention can be made of phenol derivatives, hydroxynaphthalene derivatives, and active methylene group-containing compounds. Particular examples of phenol derivatives include the mono-, di-, or tri-, benzene phenols including for example, the derivatives of the α-, β-, and γ-resorcylic acids. Specific examples of the phenol derivatives include for example: pyrocatechol, resorcin, phloroglucinol, resorcin monoglycol ether, pyrogallol-4-carboxylic acid, 3-hydroxy-p-toluylic acid, 6-hydroxy-m-toluylic acid, 5-hydroxy-1-naphthonic acid, 2,2', tetra 4,4-hydroxybiphenyle, 2,5-dihydroxyacetophenone, 1,3-dimethyl ether of pyrogallol, meta-hydroxy-acetoacetanilide, 2,5-dimethyl-4-morpholinomethyl phenol, 2-methyl-5-isopropyl 4-morpholinomethyl phenol, 4-morpholinomethyl-resorcinol monomethyl ether and 2,4,4'-trihydroxydiphenyl-2'-sulfonic acid.

The preferred derivatives of naphthalene include the mono- and di-hydroxy naphthalenes and the derivatives of β-naphthoic hydroxy acid. Specific examples of naphthalene derivatives include the following: 2,3-dihydroxynaphthalene, β-naphthol, α-naphthol, 1,6-dihydroxynaphthalene, 2,6-dihydroxynaphthalene, 2,7-dihydroxynaphthalene, 2,2'-dihydroxyl-1,1'-binaphthyl, 4,4'-dihydroxy-1,1'-binaphthyl, 3-carboxy-2-naphthol, 2,3-dihydroxynaphthalene-6-sulfonic acid, 1,8-aminonaphthol-5-sulfonic acid, 8-hydroxy-2-naphthionic-hydroxyethyl amide, 1-(N-carboethoxymethylamino)-8-naphthol-4-sulfonic acid.

Examples of the active methylene group-containing compounds include, for example, the derivatives of aceto-acetanilide. Specific examples of active methylene group-containing compounds, include, for example: 1-phenyl-3-methylpyrazolone (5), 1-phenyl-3-carboxypyrazolone, acetoacetic acid anilide, acetoacetic acid-o-chloroanilide, acetoacetic acid cyclohexylamide, acetoacetic acid benzylamide, cyanoacetoanilide and cyanoacetomorpholine.

In addition to the diazonium salt and the coupling agent as the color-forming reactants of the photosensitive compositions, other conventional adjuvants such as stabilizers to avoid precoupling of the diazonium salt and the coupling agent, can be included in the photosensitive compositions.

The deposited photosensitive layer will contain the diazonium salt and the coupling agent in a weight ratio of from about 0.1:1 to about 10:1, preferably between about 0.3:1 to about 3:1.

After evaporation of the solvent, the quantity of the diazonium salt and coupling agent present in the photosensitive zones deposited on the support will be in the range, excluding any of the adjuvants, of from about 5% to about 50% by weight, while the quantity of the thermally activatable adhesive resin or resins will be in the range of from about 50% to about 95% by weight.

Within these proportions the amount of the color-forming components will vary according to the thickness of the deposited photosensitive layer and the density of the image one desires to obtain.

To obtain good adherence of the deposited photosensitive layer with the supports customarily used for identification cards, the photosensitive composition, including any of the adjuvants will be deposited as a solution in a solvent medium. In addition, by choosing a solvent which is also a solvent of the support or which at least has some solvating action for the support, it is possible to further improve the adherence of the photosensitive layer and in addition, the quality of the reproduction can be improved, as noted by the reproduction of half-tones.

It has also been found that the photosensitive layer should be deposited on the support by the technique of coating by serigraphy in order to obtain a coating of good quality having precisely defined contours. In addition, the serigraphy technique is both inexpensive and readily adaptable for small series production runs.

Especially with regard to the application to the coating of the photosensitive layer by serigraphy, it has been found that the photosensitive solution should have a viscosity in the range of from about 600 centipoises to about 4000 centipoises, measured at 20° C. When the viscosity of the photosensitive solution is less than 600 cps, the solution is too fluid and flows directly through the meshes of the screen or web, without the aid of the scraper which should be used for this purpose. Accordingly, the layer deposited will not have precise contours and cannot be used for the production of identification cards.

When the viscosity of the photosensitive solution is above 4000 cps, the solution is too viscous to be able to pass through the finest meshes of the screen or mesh to be used in the serigraphic deposition.

The solvents which can be used to obtain photosensitive solutions having viscosities within the above range are those having speeds of evaporation of 25 or more, preferably 30 or more, measured relative to ethyl ether set as the reference with an evaporation rate equal to 1. That is, suitable solvents are those which have a rate of evaporation, measured at room temperature, which are at least 25 times than the rate of evaporation of ethyl ether.

By way of non-limiting examples of suitable solvents having such low rates of evaporation, mention can be made of the following commercially available solvents:

| SOLVENT | RATE OF EVAPORATION |
|---|---|
| Methylglycol acetate | 35 |
| Cyclohexanone | 40 |
| Methylcyclohexanone | 48 |
| Ethylglycol acetate | 52 |
| Orthodichlorobenzene | 57 |
| Di-isobutyl acetone | 60 |
| Cyclohexyl acetate | 77 |
| Butylglycol acetate | 190 |

In addition to using solvents having a speed of evaporation of 25 or more, the photosensitive solutions should include from about 60% to about 85% of solvent and proportionately from about 15% to about 40% of the solids, i.e. color-forming reactants, adjuvants and thermo-adhesive resin.

The photosensitive solutions are deposited on the plastic support which may first be cut to the desired shape and size or as a large plastic sheet containing a plurality of cards for subsequent separation and which can be formed from opaque or transparent plastic material, such as polyvinyl chloride or polyvinyl acetochloride, or other sufficiently flexible or rigid plastic support material, in one or more zones, by serigraphy. Details of serigraphy are well known and are described for example, in "The Techniques of Serigraphy" by Michel Caza, published by Presses du temps Present.

Generally, for the photosensitive solutions of the present invention, the screens or networks for the serigraphic deposition can be formed from nylon or polyester threads containing from about 70 to 165 threads per centimeter. The higher the resolution desired for the level of the image, the finer will be the screen used in the serigraphy technique.

After the photosensitive layer which has been locally deposited on the plastic support has been dried to a thickness on the order of about 1 to about 10 microns, the desired photograph or other images or alphanumeric information can be reproduced in the photosensitive zones of the presensitized plastic card. The reproduction of the information is accomplished by the conventional techniques used for diazo-type color reproduction. Briefly, the photosensitive zones will be exposed to actinic radiation, especially ultraviolet radiation, such as by a mercury lamp, through a positive to be reproduced. The exposure step can take place at room temperature. For example, an exposure plateholder intended for offset plates such as those sold under the trade name NU-ARC can be used. In the present invention, it is important that the thermally activatable adhesive resin is not allowed to melt or soften during the course of the exposure. Therefore, one should not use plane drawing machines since the temperature developed during the radiation with such machines is too high.

The images are then developed in an alkaline environment, such as ammonia vapors for dry development, or with an ammonium solution for wet development.

After the resulting identification card is dried, it is rendered tamperproof by applying thereto a protective plastic film which protects the information reproduced on the card from normal handling as well as from unintended intrusion, i.e. fraudulent modifications.

The techniques for laminating the protective plastic film to the identification card are well known and apparatus for perfecting the lamination of the assembly of the protective plastic film and identification card under pressure and heat are readily available.

Any of the protective plastic films generally used for protecting identification cards and which offer sufficient resistance to normal handling can be used. Preferred examples of the protective plastic films include polyvinyl chloride, polyvinyl acetochloride, polyester, and polystyrene.

When the protective plastic film is formed from a thermoplastic material which is itself a thermally activatable adhesive resin, having a VICAT softening point in the range of 40° C. to 140° C., it is not necessary to coat the surface of the protective plastic film facing the identification card with a second thermo-adhesive material. However, the use of a coating of a thermo-adhesive material on the protective plastic film is preferred. The coating of the second thermally activatable adhesive resin material on the protective plastic film need only be on the order of a few microns thick, generally from about 1 to 5 microns being sufficient. The coating can be applied by any conventional coating technique, such as by transfer rollers, kiss rollers, doctor blades, and the like.

It is also within the scope of the present invention to utilize the identification cards in combination with other forms of providing information, for example, magnetic tracks which may be placed on the back of the plastic support at any stage of the process without any danger of its deterioration and without interfering with the process for producing the tamperproof identification card. The plastic support of the identification card may also be embossed at any stage of the process to provide raised areas or embossments representing numbers, letters, etc., as an additional means for providing information. The use of magnetic stripes or tracks and embossing has become commonplace in identification cards, especially credit cards and the like, and the skilled practitioner will readily know how to incorporate such additional means of providing information on the tamperproof identification cards of this invention.

The invention will now be described in further detail in connection with the accompanying figures and representative examples.

FIG. 1 shows a sheet 10, containing 36 identification cards 12 produced simultaneously according to the process of the invention.

All of the cards are identical in layout, although, the specific photographs or other identifying information provided at the zones 20, 22, & 24, which may represent, respectively, the photograph of the bearer, an identification number and a signature, can, of course, be different.

Figure 2:
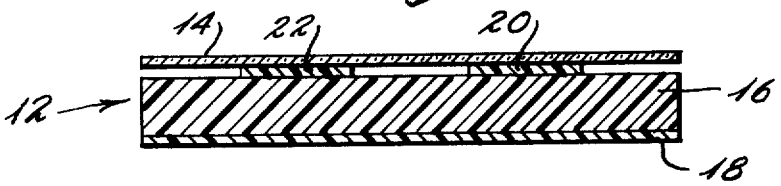
FIG. 2 is a side elevation view, in section, along the line 2—2 in FIG. 1 of a single identification card.

As shown in FIG. 2, which is a greatly expanded side elevation view of a single tamperproof identification card taken along line 2—2 of FIG. 1, the image zones 22 & 20 on the plastic support 16 are covered by a transparent plastic protecting film 14. A protective plastic film 18 is also provided on the underside of support 16. Plastic film 18 may be the same or different from plastic film 14. Plastic film 18 may also be omitted.

Figure 3:
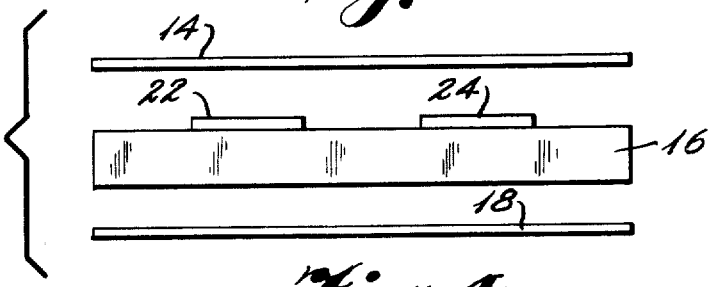
FIG. 3 is an exploded elevation view, in section, of the identification card of FIG. 2.

FIG. 3 shows an exploded view of the identification card before the exposure and development of the photosensitive layer and before the lamination of the protective plastic film to the identification card. The presensitized plastic card is formed by depositing the photosensitive zones 22' and 24' by serigraphy on plastic support 16. A photographic positive (not shown) is then placed over each of the photosensitive zones which are then exposed with ultraviolet light with the aid of a plateholder chassis of the NU-ARC type. The reproduced colored image is then developed by passage through an ammonia atmosphere. The resulting identification card is then covered with the transparent protective film 14 and 18 and the assembly is then hot-pressed to effect lamination.

Figure 4:
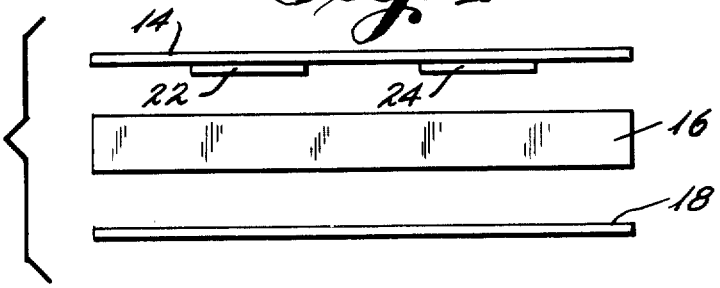
FIG. 4 is an exploded side elevation view, in section, showing an alternative embodiment for assembling the components of a tamperproof identification card according to the invention.

In the embodiment illustrated in FIG. 4, the photosensitive zones 22' and 24' are first deposited directly on the undersurface of the protective plastic film 14 and then, after exposure and development, the assembly of the protective plastic film 14 and plastic support 16 are laminated together by uniting with heat and pressure.

EXAMPLE 1

The following solution is prepared:

| | |
|---|---|
| Rhodopas AXCM (polyvinyl acetochloride of the Rhone-Poulenc Company) 25 wt % in cyclohexanone | 100 g |
| Sulphosalicylic acid | 2 g |
| Thiosinamine | 1.5 g |
| Diethanolamide of 2-hydroxy-3 naphtoic acid | 0.8 g |
| m-hydroxyphenylurea | 1.5 g |

-continued

| | |
|---|---|
| 4-diazo-2, 5-dimethoxy-phenyl-morpholine-borofluoride | 1 g |

The viscosity of the solution obtained is 1,250 cps.

This solution is smeared on a support of polyvinyl chloride, which has magnetic tracks on its back, with the help of a "silk screen" made of polyester monofilament (100 filaments/cm having a mesh opening of 58 microns, a fiber diameter of 40 microns, and a thickness of 65 microns, available from BUISINE Establishment). The thickness of the deposited layer, after evaporation of the solvent, is 5 microns. The photosensitive layer is irradiated with ultraviolet light for 30 seconds on a chassis or plate-holder of the NU-ARC-type through a woven photographic original positive (web 150, i.e., 150 points by 2.54 cm). The image is then developed by passage in ammonia vapors, to obtain a blue-black positive image adhering perfectly to the support. The card (or the ensemble of cards, as described in FIG. 1) is then covered with a leaf of transparent polyvinyl acetochloride, and the assembly is then laminated at 110° C. under pressure.

After cooling, a tamper proof identification card is obtained in which all the points of the photographic original positive are clear and perfectly reproduced. Moreover, it is not possible to separate the protective film and the support in the zones where the image is located, even with the help of a razor blade, without destroying it completely. Even if the card is heated up to 140° C. the film cannot be unglued from the support in the image zones. In addition, at such a temperature, the card is no longer reusable.

EXAMPLE 2

The following solution is prepared:

| | |
|---|---|
| Rhodopas M (vinyl acetate of the Rhone-Poulenc Company) at 30 wt % in acetate of methylglycol | 100 g |
| Sulphosalicylic acid | 2 g |
| Thiosinamine | 1.5 g |
| 2-methylanilide of 2-hydroxynaphthoic acid | 0.5 g |
| 2,4,2',4'-tetrahydroxy diphenyl-sulfide | 0.5 g |
| 4-diazo-2,5-diethoxy phenyl morpholine borofluoride | 1 g |

This solution obtained has a viscosity of 600 cps.

This solution is smeared on a support of polyvinyl chloride as in example 1. After photoexposure and development, a maroon-sepia image is obtained. Lamination is carried out at 110° C. under pressure, with a protective film of transparent polyvinyl chloride covered with a layer of polyvinyl acetate having a thickness of 3 microns. The same results of card inviolability as in example 1 are obtained.

EXAMPLE 3

The following solution is prepared:

| | |
|---|---|
| LUCOVYL PB 8015 (polyvinyl chloride of the Rhone-Poulenc Company) at 20 wt % in cyclohexanone | 100 g |
| Sulphosalicylic acid | 2 g |
| Thiosinamine | 1.5 g |
| 2-hydroxynaphthalene-3-carboxylic acid | 0.8 g |
| γ-morpholino propylamide cyano aceto morpholide | 0.48 g |
| 2,3-dihydroxy naphthalene | 0.08 g |
| m-Hydroxyaceto acetanilide | 0.1 g |
| 4-diazo 2,5 diethoxy phenylmorpholine borofluoride | 1.2 g |

A photosensitive solution with a viscosity of 2500 cps is obtained.

This solution is deposited by serigraphy on a support of polyvinyl acetochloride through a web 70 (opening: 90 microns, dimension of films: 55 microns, thickness of the web: 90 microns). The thickness of the deposited layer is 6 microns. Photoexposure and development of the images is performed as in example 1. A positive image with a maroon-black color is obtained. Lamination (or the "plasticizing" of the card) is carried out at 110° C. under pressure with a film of polyethylene terephthalate, covered with a layer of 2 microns of polyester resin DYNAPOL L 206 (of the Dynamit Nobel Company). The same results of inviolability as in example 1 are obtained.

EXAMPLE 4

The following solution is prepared:

| | |
|---|---|
| DYNAPOL L 206 at 30 wt % in the acetate of methylglycol | 100 g |
| Sulphosalicylic acid | 2 g |
| Thiosinamine | 1.5 g |
| β-hydroxy ethylamide of 2-hydroxy-3-naphthoic acid | 0.2 g |
| m-hydroxy phenylurea | 1 g |
| Diethanolamide of 2-hydroxy-3-napthoic acid | 0.6 g |
| 4-diazo-2-5-diethoxy phenyl morpholine borofluoride | 1.5 g |

The viscosity of the resulting photosensitive solution is 600 cps.

With this solution a tamperproof identification card, under the same conditions as described in example 1, is achieved.

The same results of inviolability are obtained as in example 1.

EXAMPLE 5

The following solution is prepared:

| | |
|---|---|
| VINNOL H 40/60 (polyvinyl acetochloride of the WACKER Company) at 25 wt % in methylglycol acetate | 100 g |
| Sulphosalicylic acid | 2 g |
| Thiosinamine | 1.5 g |
| β-hydroxy phenylurea | 0.8 g |
| Amide of β-resorcylic acid | 0.2 g |
| 4-diazo-2-methyl-1-pyrolidino benzene borofluoride | 1.2 g |

This photosensitive solution has a viscosity of 1600 cps.

A layer of this solution with a thickness of 3 microns is deposited by serigraphy with a web 140 (mesh opening: 33 microns, thread diameter: 37 microns, web thickness: 66 microns), on a transparent protective film of polyvinyl acetochloride. After photoexposure and development as in example 1, a brown-black image is obtained. The film with the developed images is then laminated at 110° C. and under pressure to a support of polyvinyl chloride.

The same results as in example 1 are obtained.

What is claimed is:

1. A tamperproof identification card bearing information which may be in the form of photograph, images, indicia and the like, which comprises:

a plastic support and one or more exposed and developed photosensitive zones carried on at least one of the major surfaces of said support, said zone comprising an exposed and developed layer of a photosensitive composition comprising an intimate mixture of (a) at least one photosensitive diazonium salt, (b) a coupling agent for said salt, and (c) at least one first thermally activated adhesive resin having a VICAT softening point in the range of from about 40° C. to about 140° C., the weight ratio of the salt plus coupling agent to the adhesive resin being from about 50:50 to about 5:95; said photosensitive zones having been exposed to actinic light through an original to be reproduced, to decompose the diazonium salt in the exposed portions of said zones, the unexposed portions of said zones having been developed in an alkaline medium to form photograph, images, indicia, and the like and then dried; and a protective plastic film consisting essentially of, or having at least one surface layer consisting essentially of, a second thermally activated adhesive resin having a VICAT softening point in the range of 40° C. to 140° C., and laminated to the layer side of said support and the dried, developed photosensitive composition; wherein at least one of said support and said protective plastic film is transparent, whereby the information provided by the developed photosensitive composition can be viewed.

2. The tamperproof identification card of claim 1 wherein the layer of the exposed and developed photosensitive composition has a uniform thickness in the range of from about 1 to about 10 microns.

3. The tamperproof identification card of claim 1 wherein the weight ratio between the diazonium salt and the coupling agent is in the range of from about 0.1:1 to about 10:1.

4. The tamperproof identification card of claim 1 wherein the weight ratio between the diazonium salt and the coupling agent is in the range of from about 0.3:1 to about 3:1.

5. The tamperproof identification card of claim 1 wherein the first adhesive resin has a VICAT softening point in the range of from about 50° C. to about 100° C.

6. The tamperproof identification card of claim 1 wherein the first adhesive resin is selected from the group consisting of polyvinylacetate, polyvinylacetochloride, polyvinylchloride and polyester resin, or mixtures thereof.

7. The tamperproof identification card of claim 6 wherein the support is polyvinylchloride or polyvinylacetochloride.

8. The tamperproof identification card of claim 1 wherein said protective plastic film comprises polyvinylchloride, polyvinylacetochloride, polyester or polystyrene.

9. The tamperproof identification card of claim 8 wherein the surface of said protective plastic film in contact with the support and the exposed and developed photosensitive composition is coated with said second thermally activated adhesive resin having a VICAT softening point in the range of from about 40° C. to about 140° C.

10. The tamperproof identification card of claim 9 wherein the VICAT softening point of the second thermally activated adhesive resin is in the range of from about 50° C. to about 100° C.

11. The tamperproof identification card of claim 9 wherein the first and second adhesive resins are the same or different and are selected from the group consisting of polyvinylacetate, polyvinylacetochloride, polyvinylchloride and polyester resin.

12. The tamperproof identification card of claim 9 wherein said second thermally activated adhesive resin is selected from the group consisting of polyvinylacetate, polyvinylacetochloride and polyvinylchloride.

13. The tamperproof identification card of claim 11 wherein the first and second adhesive resins are the same.

14. The tamperproof identification card of claim 11 wherein the first and second adhesive resins are different.

15. The tamperproof identification card of claim 8 wherein the exposed and developed photosensitive composition has a thickness of from about 1 to about 10 microns and wherein the weight ratio between the diazonium salt and the coupling agent is in the range of from about 1:1 to about 10:1.

16. The tamperproof identification card of claim 29 wherein said support comprises polyvinylchloride or polyvinylacetochloride.

17. The tamperproof identification card of claim 11 wherein said support comprises polyvinylchloride or polyvinylacetochloride.

18. The tamperproof identification card of claim 1 which further comprises at least one magnetic track carried by said support.

19. The tamperproof identification card of claim 1 which further comprises additional information embossed into said support.

20. The tamperproof identification card of claim 1 wherein the protective plastic film is itself formed from said second thermally activated adhesive resin.

* * * * *